US011987418B2

(12) United States Patent
Moore

(10) Patent No.: US 11,987,418 B2
(45) Date of Patent: May 21, 2024

(54) FOLDED POST RUNNER

(71) Applicant: Sonoco Development, Inc., Hartsville, SC (US)

(72) Inventor: Clifton Moore, Murfreesboro, TN (US)

(73) Assignee: Sonoco Development, Inc., Hartsville, SC (US)

( * ) Notice: Subject to any disclaimer, the term of this patent is extended or adjusted under 35 U.S.C. 154(b) by 216 days.

(21) Appl. No.: 17/693,075

(22) Filed: Mar. 11, 2022

(65) Prior Publication Data

US 2023/0286696 A1 Sep. 14, 2023

(51) Int. Cl.
*B65D 19/00* (2006.01)

(52) U.S. Cl.
CPC ..... *B65D 19/0004* (2013.01); *B65D 2519/00054* (2013.01); *B65D 2519/00338* (2013.01)

(58) Field of Classification Search
CPC ..... B65D 19/0004; B65D 2519/00054; B65D 2519/00338
USPC ..... 248/188.8, 346.02; 108/51.3, 56.1
See application file for complete search history.

(56) References Cited

U.S. PATENT DOCUMENTS 4,485,610 A 12/1984 Gilley
6,135,030 A * 10/2000 Besaw ..... B65D 19/0012 108/51.3
7,086,338 B2 * 8/2006 Horiuchi ..... B65D 19/0012 108/51.3
7,322,480 B2 * 1/2008 Bragadeste ..... B65D 19/20 53/458
7,347,326 B2 3/2008 Baechle
8,459,190 B2 6/2013 Erdie
8,601,955 B2 * 12/2013 Casey ..... B65D 19/40 108/51.3
10,301,066 B2 * 5/2019 Van Riper ..... B65D 19/20
2004/0237850 A1 12/2004 Horiuchi
2009/0308289 A1 * 12/2009 Ferguson ..... B31D 5/0086 29/428

FOREIGN PATENT DOCUMENTS

CN 201432849 Y 3/2010
JP 0280538 U 6/1990

OTHER PUBLICATIONS

International Search Report and Written Opinion related to Application No. PCT/US2023/014869; dated Jun. 30, 2023.

* cited by examiner

*Primary Examiner* — Anita M King
(74) *Attorney, Agent, or Firm* — von Briesen & Roper, s.c.

(57) ABSTRACT

A folded post support system for supporting a pallet, comprising a hollow elongated enclosure and an insert disposed with the interior of the enclosure. The insert is made from a hollow cylindrical structural post that has been folded in an accordion fashion to form a series of post segments. Each post segment is connected to at least one adjacent post segment along a living hinge.

18 Claims, 5 Drawing Sheets

FOLDED POST RUNNER

BACKGROUND OF THE INVENTION

Field of the Invention

This disclosure relates to a pallet runner, that is, an elongated structure for supporting a pallet or other flat structure for transporting a load. More particularly, this disclosure relates to a folded post support system comprising a Z-folded paperboard enclosure inserted into a hollow elongated paperboard enclosure.

Description of the Related Art

Existing paper based pallet supports use cut off spiral wound cores for the vertical support structure. These supports are limited to a cylindrical shape that does not provide much surface area for withstanding a straight-on impact from a forklift fork during rough handling.

The present disclosure is designed to solve the problems described above.

BRIEF SUMMARY OF THE INVENTION

The present disclosure relates to a folded post support system comprising a Z-folded paperboard enclosure inserted into a hollow elongated paperboard enclosure.

In one aspect the disclosure relates to a folded post support system for supporting a pallet, the support system comprising a rectilinear, hollow elongated enclosure and an insert disposed within the interior of the enclosure.

The hollow elongated enclosure is made from a single folded blank and defines an interior having a length (Le). The insert is made from a hollow cylindrical structural post that has been cut and then folded in an accordion fashion. The insert has a length (Li).

The post comprises an outer wall, an inner wall, a first side wall extending between the outer wall and the inner wall, a second side wall extending between the outer wall and the inner wall opposite the first side wall, two outer corners extending longitudinally from an end of the post to an opposite end, and two inner corners extending longitudinally from an end of the post to an opposite end. The post has a length ($L_p$).

The post defines a plurality of cuts, each cut extending peripherally but only partially around the post so that one of the two side walls is uncut and forms a living hinge. The cuts are evenly distributed along the length ($L_p$) of the post in the longitudinal direction to create a plurality of connected hollow cylindrical segments of equal lengths.

In the post, each cut defines a plane that is orthogonal to the longitudinal axis of the post. The cuts alternate in the longitudinal dimension, with every other cut extending across only the first side wall but not the second side wall, and the remaining cuts extending across the second side wall but not the first side wall.

Each post segment comprises an outer wall corresponding to part of the post outer wall, an inner wall corresponding to part of the post inner wall, two outer corners corresponding to parts of the two post outer corners, two inner corners corresponding to parts of the two post inner corners, a first side wall corresponding to part of the post first side wall and a second side wall corresponding to part of the post second side wall.

The living hinges alternate in the longitudinal dimension between the first side wall and the second side wall, thereby enabling the post to be accordion folded to form the insert.

In the assembled insert, each post segment is connected to at least one adjacent post segment along one of the living hinges, and at least one sidewall of each post segment abuts a sidewall of an adjacent post segment.

In the assembled support system, the insert has a height ($H_i$) substantially the same as the enclosure interior height ($H_e$) and a width ($W_i$) substantially the same as the enclosure interior width ($W_e$) to fit snugly within the enclosure. The length ($L_i$) of the insert equals the length ($L_e$) of the enclosure.

In another aspect, a folded post support system is provided comprising a hollow elongated enclosure defining an interior and having a length ($L_e$); and an insert disposed within the interior of the enclosure. The insert is made from a hollow post that has been cut and then folded in an accordion fashion.

The post comprises an outer wall, an inner wall a first side wall extending between the outer wall and the inner wall, a second side wall extending between the outer wall and the inner wall opposite the first side wall, and two longitudinal ends. The post defines a plurality of cuts, each cut extending peripherally but only partially around the post so that either the first side wall or the second side wall is uncut and forms a living hinge. The cuts are evenly distributed along a length ($L_p$) of the post in the longitudinal direction to create a plurality of connected hollow segments of equal lengths.

In the assembled insert, each post segment is connected to at least one adjacent post segment along a living hinge; and at least one sidewall of each post segment abuts a sidewall of an adjacent post segment.

In another aspect, the disclosure relates to an insert useful as a component of a load support system. The insert comprises a plurality of hollow cylindrical post segments arranged side-by-side, each post segment having a hollow interior and comprising an outer wall, an inner wall, two outer corners, two inner corners and two side walls. Each post segment is connected to at least one adjacent post segment along a linear hinge line. The post segments are aligned in a longitudinal direction with at least one side wall of each post segment abutting a side wall of an adjacent post segment. Each post segment has a height ($H_i$) equal to the height of the other post segments. The insert has top, a bottom, and a length (Li) in the longitudinal direction. The hinge lines alternate in the longitudinal dimension between the top of the insert and the bottom of the insert.

DETAILED DESCRIPTION OF THE INVENTION

Figure 1:
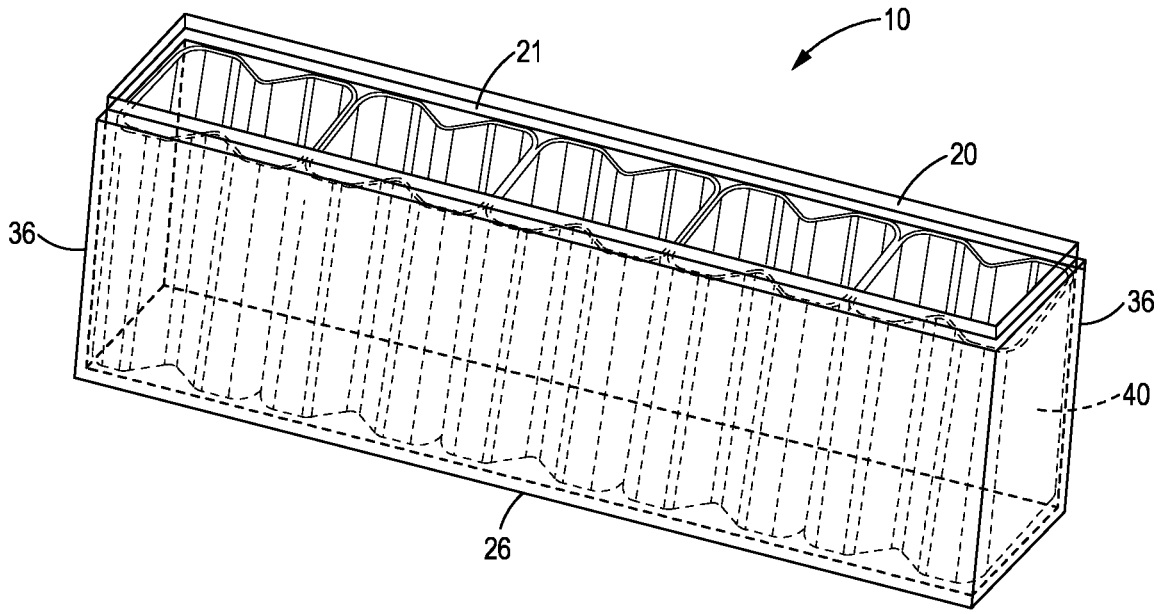
FIG. 1 is perspective view of a folded post support system according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "top", "bottom", "side", "outer", "inner", "upward" and "downward", used as nouns, adjectives or adverbs, refer in this description to the orientation of the structure of the wrapper as it is illustrated in the various views. Such terms are not intended to limit the invention to a particular orientation.

Turning to the drawings, where like numerals indicate like elements, there is shown in FIG. 1 one embodiment of the present invention, a folded post support system (aka pallet runner) for supporting a pallet or other flat structure used in transporting a load. The system 10 may comprise a paperboard post 60 that has been Z-folded or accordion folded to create an insert 40 that fits snugly within a hollow elongated paperboard enclosure 20. The insert 40 may be made by cutting and folding a paperboard post 60 of the kind manufactured and sold by Sonoco Products Company of Hartsville, S.C. under the trademark Sonopost™.

The Enclosure 20

Figure 2:
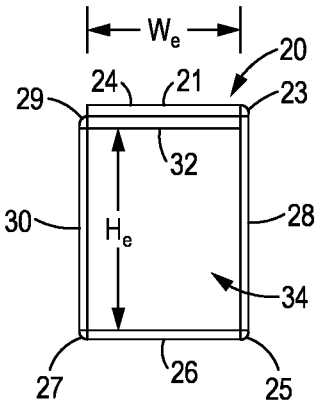
FIG. 2 is an end view of an enclosure used as a component of the folded post support system of FIG. 1.
Figure 3:
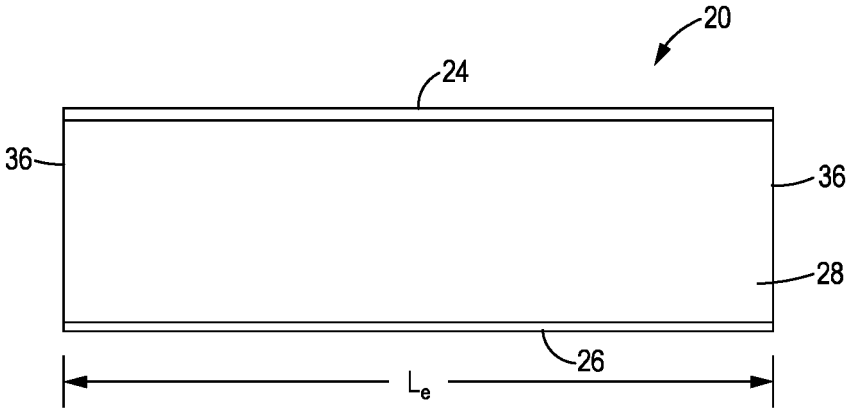
FIG. 3 is a side view of the enclosure of FIG. 2.

FIG. 2 is an end view of a representative enclosure 20 and FIG. 3 is a side view of the enclosure 20 used as a component of the folded post support system 10 of FIG. 1. In the illustrated embodiment the enclosure 20 comprises a double thickness top wall 21, a bottom wall 26 and two opposing and substantially identical side walls 28, 30. Preferably each of the top wall 21, bottom wall 26 and side walls 28, 30 is rectangular.

The top wall 21 may comprise a top outer panel 24 and a top inner panel 32. The top outer panel 24 may be hingedly attached to a first side wall 28 along a first fold line 23. The first side wall 28 may be hingedly connected to the bottom wall 26 along a second fold line 25. The bottom wall 26 may be hingedly connected to a second side wall along a third fold line 27. The second side wall 30 may be hingedly connected to the top inner panel 32 along a fourth fold line 29. The enclosure 20 defines an interior 34 having a height ($H_e$) and a width ($W_e$).

The enclosure 20 extends from one end 36 to an opposite end 36. Each of the two ends 36 of the enclosure 20 are open (communicate with the outside) to allow the insertion and/or removal of the insert 40. The enclosure 20 has a length ($L_e$) as measured in the longitudinal (axial) or end-to-end dimension.

The Blank 22

Figure 4:
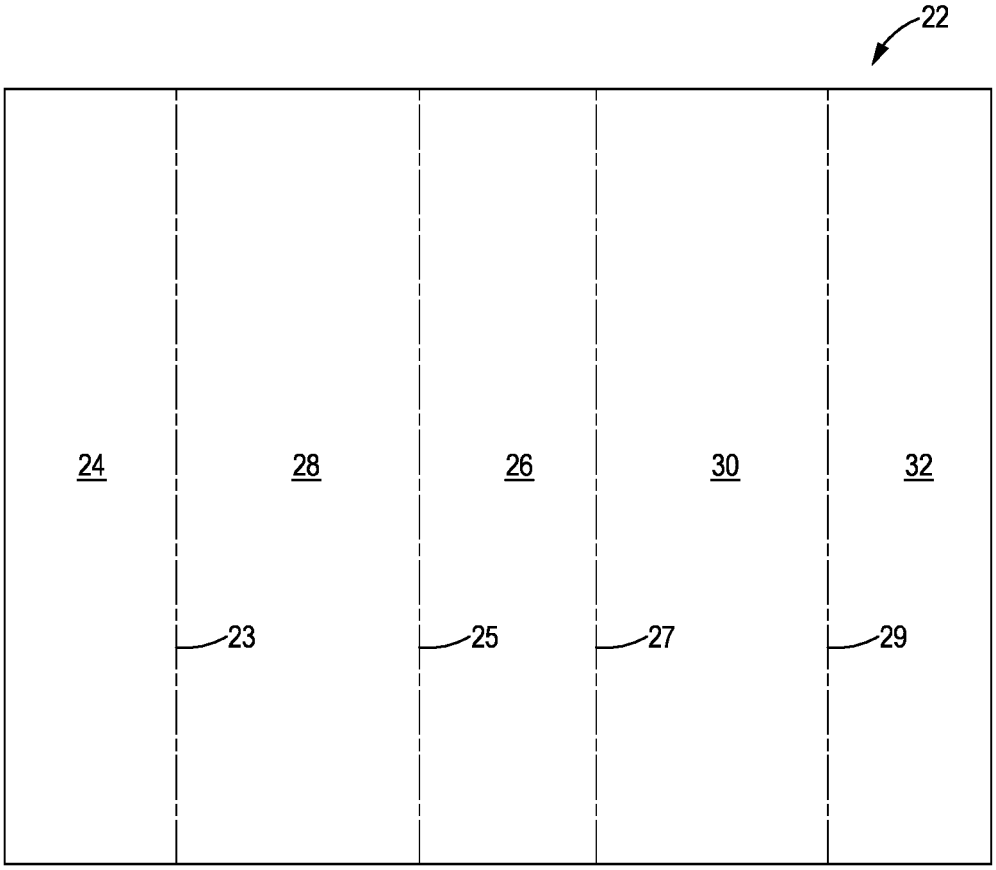
FIG. 4 is a top view of a blank used to make the enclosure of FIGS. 2-3.

The hollow elongated enclosure 20 may be made from a single folded paperboard or corrugated blank 22. FIG. 4 is a top view of a representative blank 22 used to make the enclosure 20 of FIGS. 2-3. The blank 22 is rectangular and comprises a top outer panel 24, a first side wall 28, a bottom wall, a second side wall 30 and a top inner panel 32. As with the enclosure 20, the top outer panel 24 may be hingedly attached to a first side wall 28 along a first fold line 23. The first side wall 28 may be hingedly connected to the bottom wall 26 along a second fold line 25. The bottom wall 26 may be hingedly connected to a second side wall 30 along a third fold line 27. The second side wall 30 may be hingedly connected to the top inner panel 32 along a fourth fold line 29.

Assembling the Enclosure 20

The enclosure 20 of FIGS. 2-3 may be assembled in the following manner. Starting with the blank 22 of FIG. 4, the blank 22 may be folded along the fourth fold line 29 until the top inner panel 32 is orthogonal (at a right angle) to the second side wall 30. Next, the blank 22 may be folded along third fold line 27 until the second side wall 30 is orthogonal to the bottom wall 26. Continuing in this manner, the blank 22 may be folded along second fold line 25 until the bottom wall 26 is orthogonal to the first side wall 28. Finally, the blank 22 may be folded along first fold line 23 until the top outer panel 24 is orthogonal to the first side wall 28. In this configuration the top outer panel 24 should be in flat facing abutment with the top inner panel 32 and may be adhered or otherwise affixed thereto to create the assembled enclosure 20.

The Post 60

The insert 40 may be made from a hollow, cylindrical paperboard post 60 that is strategically cut in such a manner that the cut post 60 can "Z fold" or "accordion fold" onto itself to create an insert 40 that can be inserted into the hollow corrugated enclosure 20. The term "cylindrical" as used herein refers to the shape of a structure having a surface that can be traced by a straight line moving parallel to a fixed straight line and intersecting a planar closed curve or polygon.

Figure 5:
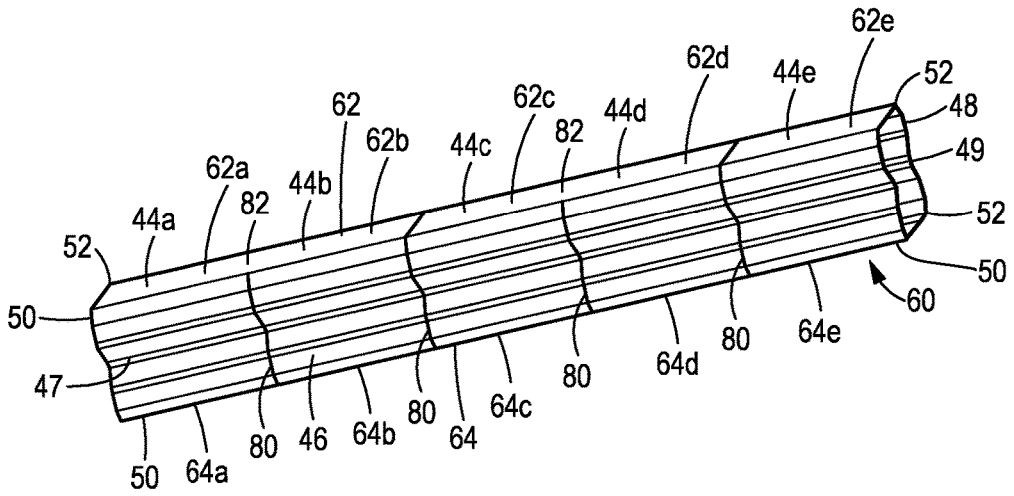
FIG. 5 is a perspective view of a cut but unfolded post according to the disclosure.

FIG. 5 is a perspective view of a cut-but-unfolded post 60 according to the disclosure. The post 60 may be made from convolutely wound paperboard, and may comprise an outer wall 46 (facing the viewer of FIG. 5), an inner wall 48 (facing away from the viewer in FIG. 5), a first side wall 62 (facing upward in FIG. 5) and a second side wall 64 (facing downward in FIG. 5).

Each side wall 62, 64 is substantially planar and extends the length of the post 60 and connects the outer wall 46 and the inner wall 48. More specifically, the outer wall 46 meets the first side wall 62 along their length to form an outer corner 50. The outer wall 46 meets the second side wall 64 along their length to form another outer corner 50. Similarly, the inner wall 48 meets the first side wall 62 along their length to form an inner corner 52. The inner wall 48 meets the second side wall 64 along their length to form another inner corner 52.

For added strength, an optional outer bead 47 extends the length of the outer wall 46, and an optional inner bead 49 extends the length of the inner wall 48. The beads 47, 49 may be aligned with each other as shown in FIG. 5, rendering the post 60 symmetrical, or they may be misaligned. Alternatively, the post 60 may define more than one bead on one or multiple walls and sides, or lack beads entirely. For example, the post may have a substantially rectangular cross section (with optional rounded corners) lacking any beads.

Still referring to FIG. 5, the post 60 defines a plurality of cuts 80, each cut 80 extending partially around the post 60. The cuts 80 are evenly distributed along the length ($L_p$) of the post 60 in the axial (longitudinal) direction to create a plurality of connected segments 44 of equal lengths (as measured in the axial direction). More specifically, each cut 80 extends peripherally along both the outer wall 46 and the inner wall 48 but along only one of the two side walls 62, 64, leaving the other side wall 62, 64 uncut. Each uncut section 82 functions as living hinge as explained further below.

Each cut 80 defines a plane that is orthogonal to the longitudinal axis of the post 60. The cuts 80 alternate in the axial dimension, with every other cut 80 extending across only the first side wall 62 but not the second side wall 64, and the remaining cuts 80 extending across the second side wall 64 but not the first side wall 62. Viewed another way, the uncut sections 82 alternate in the axial dimension between the first side wall 62 and the second side wall 64.

As noted above, each uncut section 82 functions as a hinge line 82, enabling the post 60 to be accordion folded or Z folded to form an insert 40 such as the insert 40 shown in FIGS. 7-10. The cuts 80 are separated from each other a distance equal to or just slightly less than the internal height ($H_e$) of the enclosure 20. Stated another way, each segment 44 has a length ($L_s$) (FIG. 6) equal to or just slightly less than the internal height ($H_e$) of the enclosure 20. It may be said that the length $L_s$ of the segments 44 in the post 60 of FIG. 6 becomes the internal height ($H_e$) of the folded insert 40 in FIG. 8.

Still referring to FIG. 5, and as noted above, the cuts 80 divide the post 60 into multiple segments 44. In the illustrated embodiment, the cuts 80 divide the post 60 into five hollow, cylindrical segments 44*a*-44*e* arranged end-to end. Accordingly, the segments 44*a-e* share a common interior 45, outer wall 46, outer bead 47, inner wall 48, inner bead 49, outer corners 50 and inner corners 52.

Figure 9:
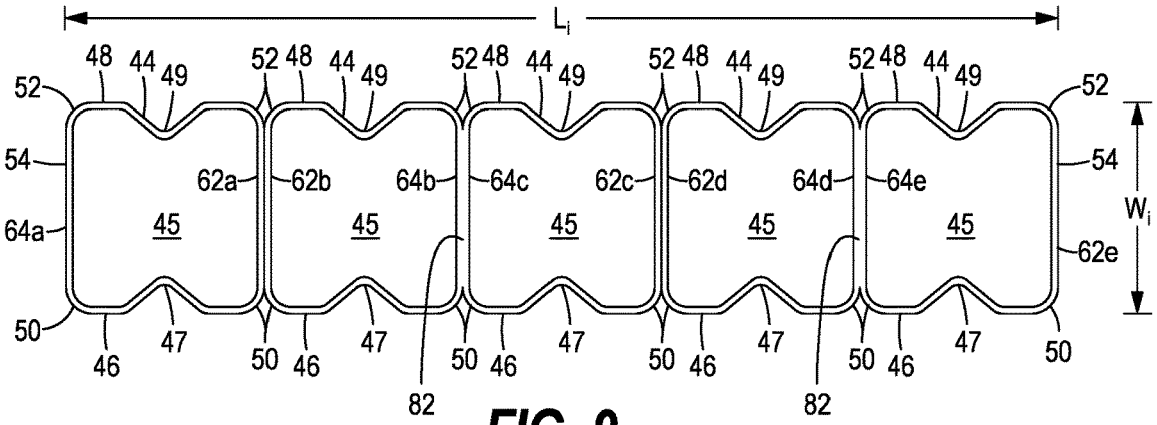
FIG. 9 is a top view of the folded post (insert) of FIG. 7.

For example, each segment 44*a-e* has a corresponding segment first side wall 62*a-e* and a corresponding segment second side wall 64*a-e*. When the post 60 is folded as shown in FIG. 9, these side wall segments become the internal walls and end walls of the insert 40. More specifically, segment side walls 62*e* and 64*a* become the ends walls, and the remaining segment side walls hinge together to become the double thickness internal walls of the insert 40.

Figure 6:
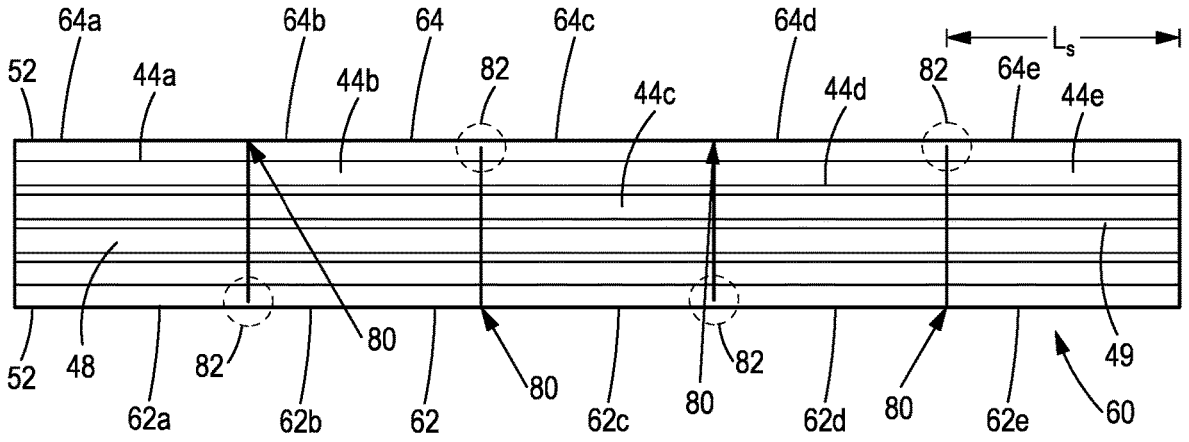
FIG. 6 is an elevational view of the unfolded post of FIG. 5.

FIG. 6 is an elevational view of the post 60 of FIG. 5 with the inner wall 48 facing the viewer. The length ($L_s$) of each segment 44 is the same. The uncut sections 82 are barely visible in this view.

The Insert 40

Figure 7:
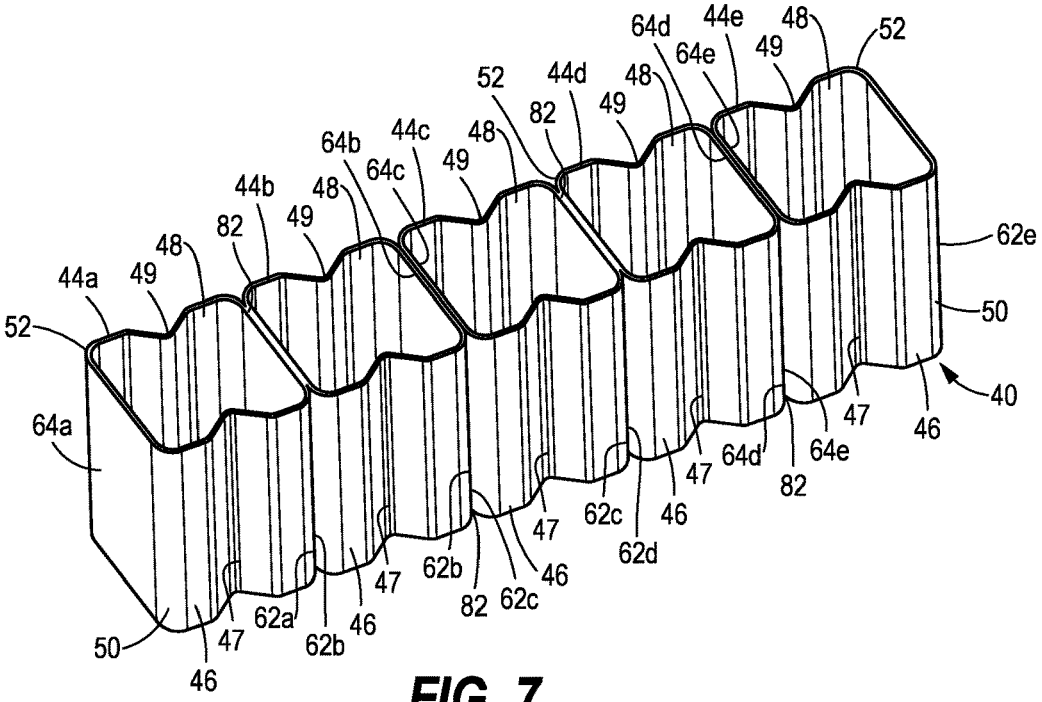
FIG. 7 is a perspective view of a folded post (insert) used as a component of the folded post support system of FIG. 1.

FIG. 7 is a perspective view of an exemplary insert 40 that may be used as a component of the folded post support system 10 of FIG. 1. The insert 40 comprises a plurality of hollow cylindrical post segments 44*a*-44*e* arranged side-by-side with at least one side wall 64 of each segment 44 in flat facing abutment with a side wall 64 of an adjacent segment 44. Each segment 44 has a hollow interior 45.

Figure 8:
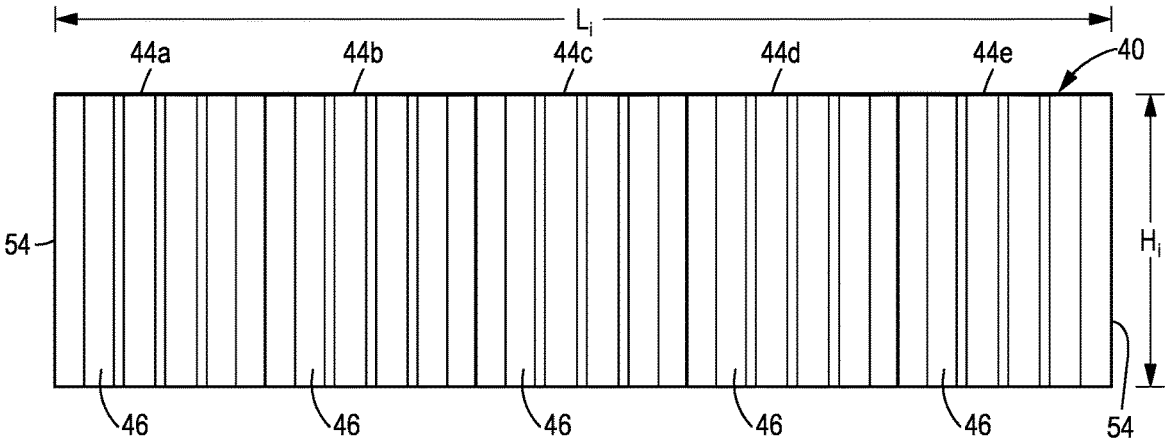
FIG. 8 is a side view of the folded post (insert) of FIG. 7.

FIG. 8 is a side view of the insert 40 of FIG. 7. The insert 40 has a height ($H_i$), a width ($W_i$) and a length ($L_i$) extending longitudinally from one end 54 to the opposite end 54. In the folded insert 40, the height ($H_i$) of the insert 40 equals the length ($L_s$) (FIG. 6) of each segment 44. Preferably the length ($L_i$) of the insert 40 equals the length ($L_e$) of the enclosure 20.

FIG. 9 is a top view of the insert 40 of FIG. 7. Each post segment 44*a*-44*e* comprises an outer wall 46, an inner wall 48, two outer corners 50, two inner corners 52 and two side walls 62, 64. Each post segment 44 is connected to at least one adjacent post segment 44 along a linear hinge line 82.

The post segments 44*a*-44*e* are aligned in the longitudinal direction with at least one side wall of each post segment 44 abutting a side wall of an adjacent post segment 44. For example, second side wall 64*e* of segment 44*e* is hingedly attached to (via hinge line 82) and abuts second side wall 64*d* of segment 44*d*. First side wall 62*d* of segment 44*d* is hingedly attached to and abuts first side wall 62*c* of segment 44*c*. Second side wall 64*c* of segment 44*c* is hingedly attached to (via hinge line 82) and abuts second side wall 64*b* of segment 44*b*. And first side wall 62*b* of segment 44*b* is hingedly attached to and abuts first side wall 62*a* of segment 44*a*. First side wall 62*e* forms one end 54 of the insert 40 and second side wall 64*a* of segment 44*a* forms the opposite end 54.

Figure 10:
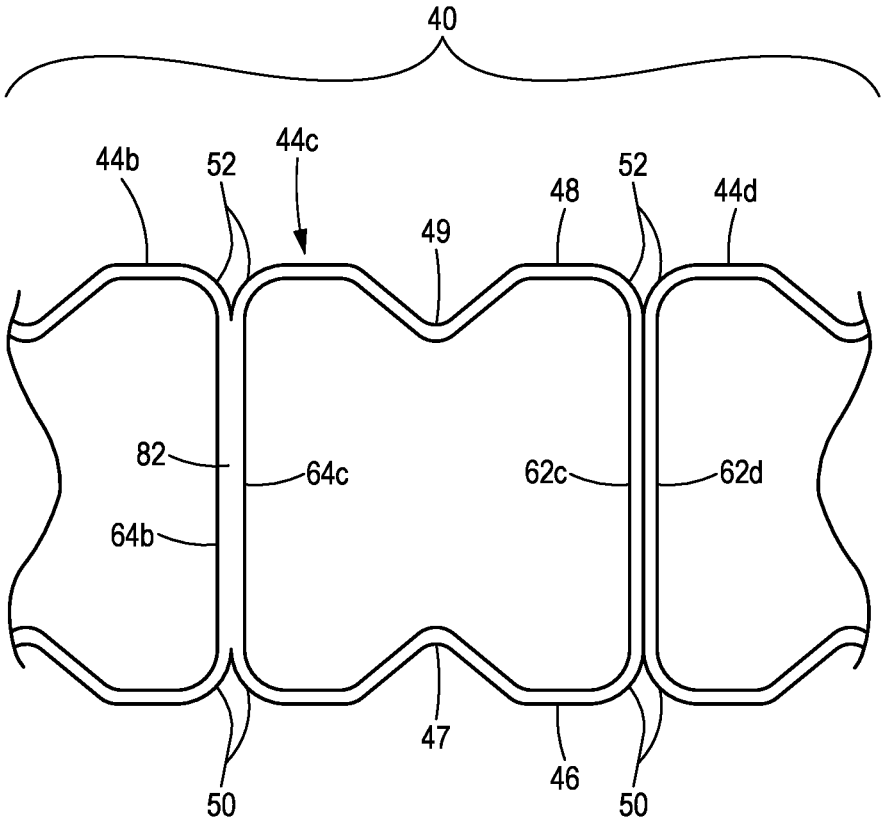
FIG. 10 is a partial close up view of the folded post (insert) of FIG. 9.

FIG. 10 is a partial close up view of the insert 40 of FIG. 7. The outer wall 46 of each segment 44 may define an integrally formed outer bead 47 extending the height of the outer wall 46. The bead 47 may be spaced from each of the outer corners 50. Likewise, each inner wall 48 may define an integrally formed inner bead 49 extending the height of the inner wall 48, the inner bead 49 being spaced from the inner corners 52.

Assembling the System 10

The system 10 may be assembled by first assembling an insert 40. The insert 40 may be assembled in the following manner. Starting with the post 60 of FIG. 5, the post 60 is folded along the hinge lines 82 in a Z or accordion manner to achieve the shape of the folded insert 40 of FIG. 7. Optionally, before folding, adhesive may be placed in predetermined locations along the post side walls 62, 64 so that adjacent segment side walls 62, 64 adhere together. Once the insert 60 is assembled, it may be inserted into an open end 36 of an assembled enclosure 20 and, optionally, affixed thereto to create the folded post support system 10.

INDUSTRIAL APPLICABILITY

The folded post support system 10 can be used as a base or a foot for a paper pallet of other load bearing structure. Alternatively, the system 10, or the insert 40 alone, can be used as a component of a multi-material assembly in place of a paper pallet.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A folded post support system for supporting a pallet, the support system comprising:

a rectilinear, hollow elongated enclosure made from a single folded blank, the enclosure defining an interior and having a length (Le); and an insert disposed within the interior of the enclosure, the insert made from a hollow cylindrical structural post that has been cut and then folded in an accordion fashion, the insert having a length (Li);

the post comprising an outer wall, an inner wall, a first side wall extending between the outer wall and the inner wall, a second side wall extending between the outer wall and the inner wall opposite the first side wall, two outer corners extending longitudinally from an end of the post to an opposite end, and two inner corners extending longitudinally from the end of the post to the opposite end, the post having a length (Lp);

the post defining a plurality of cuts, each cut extending peripherally but only partially around the post so that one of the two side walls is uncut and forms a living hinge, the cuts being evenly distributed along the length (Lp) of the post in the longitudinal direction to create a plurality of connected hollow cylindrical segments of equal lengths;

each segment comprising an outer wall corresponding to part of the post outer wall, an inner wall corresponding to part of the post inner wall, two outer corners corresponding to parts of the two post outer corners, two inner corners corresponding to parts of the two post inner corners, a first side wall corresponding to part of the post first side wall and a second side wall corresponding to part of the post second side wall; wherein each post segment is connected to at least one adjacent post segment along one of the living hinges; and at least one sidewall of each post segment abuts a sidewall of an adjacent post segment.

2. The folded post support system of claim 1 wherein:

each outer wall defines an integrally formed outer bead.

3. The folded post support system of claim 2 wherein:

each inner wall defines an integrally formed inner bead.

4. The folded post support system of claim 1 wherein:

the enclosure interior has a height (He) and a width (We); and the insert has a height (Hi) substantially the same as the enclosure interior height (He) and a width (Wi) substantially the same as the enclosure interior width (We).

5. The folded post support system of claim 1 wherein:

the post is made from convolutely wound paperboard.

6. The folded post support system of claim 1 wherein:

each side wall is substantially planar.

7. The folded post support system of claim 1 wherein:

each cut defines a plane that is orthogonal to the longitudinal axis of the post; and the cuts alternate in the longitudinal dimension, with every other cut extending across only the first side wall but not the second side wall, and the remaining cuts extending across the second side wall but not the first side wall.

8. The folded post support system of claim 1 wherein:

the living hinges alternate in the longitudinal dimension between the first side wall and the second side wall, thereby enabling the post to be accordion folded to form the insert.

9. The folded post support system of claim 1 wherein:

the length (Li) of the insert equals the length (Le) of the enclosure.

10. A folded post support system comprising:

a hollow elongated enclosure defining an interior and having a length (Le); and an insert disposed within the interior of the enclosure, the insert made from a hollow post that has been cut and then folded in an accordion fashion, the insert having a length (Li);

the post comprising an outer wall, an inner wall, a first side wall extending between the outer wall and the inner wall, a second side wall extending between the outer wall and the inner wall opposite the first side wall, and two longitudinal ends;

the post defining a plurality of cuts, each cut extending peripherally but only partially around the post so that either the first side wall or the second side wall is uncut and forms a living hinge, the cuts being evenly distributed along a length (Lp) of the post in the longitudinal direction to create a plurality of connected hollow segments of equal lengths; wherein, in the assembled insert each post segment is connected to at least one adjacent post segment along a living hinge; and at least one sidewall of each post segment abuts a sidewall of an adjacent post segment.

11. The folded post support system of claim 10 wherein:

the insert is made from a single folded blank.

12. The folded post support system of claim 10 wherein:

each segment comprises an outer wall corresponding to part of the post outer wall, an inner wall corresponding to part of the post inner wall, two outer corners corresponding to parts of the two post outer corners, two inner corners corresponding to parts of the two post inner corners, a first side wall corresponding to part of the post first side wall and a second side wall corresponding to part of the post second side wall.

13. An insert useful as a component of a load support system, the insert comprising:

a plurality of hollow cylindrical post segments arranged side-by-side, each post segment having a hollow interior and comprising an outer wall, an inner wall, two outer corners, two inner corners and two side walls; wherein each post segment is connected to at least one adjacent post segment along a linear hinge line; and the post segments are aligned in a longitudinal direction with at least one side wall of each post segment abutting a side wall of an adjacent post segment.

14. The insert of claim 13, wherein:

the outer wall of each post segment defines an integrally formed outer bead extending a height of the outer wall, the outer bead spaced from each of the outer corners; and the inner wall of each post segment defines an integrally formed inner bead extending a height of the inner wall, the inner bead being spaced from the inner corners.

15. The insert of claim 13, wherein:

the insert is made from convolutely wound paperboard.

16. The insert of claim 13, wherein:

each side wall is substantially planar.

17. The insert of claim 13, wherein:

each post segment has a height (Hi) equal to the height of the other post segments.

18. The insert of claim 13, wherein:

the insert has top, a bottom, and a length (Li) in the longitudinal direction; and the hinge lines alternate in the longitudinal dimension between the top of the insert and the bottom of the insert.

* * * * *